US005727539A

United States Patent [19]

Vroom

[11] Patent Number: 5,727,539

[45] Date of Patent: Mar. 17, 1998

[54] CONVECTION OVEN WITH MULTI-LEVEL HEATING CHAMBER

[75] Inventor: Robert C. Vroom, Fuquay-Varina, N.C.

[73] Assignee: Middle by Marshall, Inc, Elgin, Ill.

[21] Appl. No.: 754,938

[22] Filed: Nov. 25, 1996

[51] Int. Cl.[6] ..... A21B 1/00

[52] U.S. Cl. ..... 126/21 A; 126/21 R; 126/273 R

[58] Field of Search ..... 126/21 R, 21 A, 126/273 R, 41 R, 19 R, 39 C; 432/176, 177; 219/400

[56] References Cited

U.S. PATENT DOCUMENTS

| | | | |
|---|---|---|---|
| 3,148,674 | 9/1964 | Boardman et al. | 126/21 A |
| 4,233,495 | 11/1980 | Scoville et al. | 126/21 A |
| 5,205,273 | 4/1993 | Sparks | 126/21 A |

*Primary Examiner*—James C. Yeung

*Attorney, Agent, or Firm*—Rhodes, Coats & Bennett, L.L.P.

[57] ABSTRACT

A convection oven is described that provides a more desirable cooking condition. The convection oven includes a cooking cavity having sidewalls, a ceiling and a floor and a combustion chamber below the cooking cavity for heating combustion gases to be supplied to the cooking cavity. A blower fan within the cooking cavity circulates air inside the cavity. As part of the airflow path from combustion chamber to the blower fan is an intermediate flow chamber disposed between the cooking cavity and the combustion chamber. By causing the combustion gases to flow through the intermediate flow chamber, a more uniform heat distribution of the combustion gases is achieved. In addition, some heat is transferred from the combustion gases to the cooking cavity floor while the combustion gases are flowing through the intermediate flow chamber. Because this heat is supplied to the cooking cavity floor rather than to the top or sides of the cooking cavity, a more desirable cooking condition is achieved.

14 Claims, 4 Drawing Sheets

CONVECTION OVEN WITH MULTI-LEVEL HEATING CHAMBER

FIELD OF THE INVENTION

This invention relates to new and improved convection ovens and more particularly to a convection oven with a multi-level heating chamber disposed below the baking cavity.

BACKGROUND OF THE INVENTION

Convection ovens have enjoyed wide-spread popularity in commercial food establishments due to their ability to quickly and efficiently cook large quantities of food. Both electric and gas-fired convection ovens are known. Gas-fired convection ovens typically include an insulated cooking cavity having an access door on the front side thereof. A heating chamber including a combustion chamber is typically located below the cooking cavity. One or more gas burners fire into the combustion chamber and heat the air within. A blower fan is disposed in the cooking cavity, typically in the rear or on one side, and draws heated air from the combustion chamber into the cooking cavity. The blower fan then mixes the heated air with air already in the cooking cavity and circulates the mixed air within the cooking cavity to cook food therein. An exhaust, typically in the upper part of the oven, exhausts air that is displaced by the heated air from the combustion chamber.

Blower fans are typically located in the rear or to one side of the cooking chamber. Various packaging considerations mean that side mounted fan positioning offers the advantage of a smaller overall footprint for convection ovens. In side fan convection ovens, the combustion burners are typically located underneath the cooking cavity. To reach the cooking cavity, newly heated air and combustion byproducts (collectively, "combustion gases") from the burners may be routed directly to the blower fan, traveling only part way up one side of the cooking cavity. This approach often results in very uneven temperature distributions both within the combustion gases themselves and between combustion gases entering the cooking chamber and the air already present in the cooking cavity ("recirculation air"). These uneven temperature distributions cause undesirable variations in cooking quality. An alternative approach aims to both lessen the temperature variations within the combustion gas and to cool the combustion gas before mixing it with the recirculation air. This is accomplished by routing the combustion gases from the burners, around the outside of the cooking cavity, first up one side, then over the top, then part way down the other side to the blower fan. This longer path allows for the combustion gases to mix within itself, thereby producing a more uniform temperature distribution. In addition, some of the combustion gases' heat is removed via heat transfer to top and the side of the cooking cavity. As a result, the top and side become hotter radiative heat sources within the cooking cavity than the other walls. However, a better baking condition results if the bottom of the cooking cavity, rather than the top or a side, is the hotter radiative heat source. Thus, a more optimum approach would be to focus the heat removed from the new combustion gases on the floor of the cooking cavity.

The obvious method for transferring heat from the new combustion gases to the floor of the cooking cavity would be to locate the combustion burners directly under the floor. However, this produces severe hot spots and also warps, damages, or destroys the cooking cavity floor. The prior art does not teach an efficient solution to this damage problem without routing the combustion gases around the side(s) of the cooking chamber, resulting in surfaces other than the floor becoming hotter radiative sources. Thus, the prior art does not teach a method for achieving a more uniform heat distribution within the combustion gases that also directs removed heat primarily at the cooking cavity floor.

SUMMARY OF THE INVENTION

The present invention solves the problems of the prior art by defining an apparatus that achieves a more uniform heat distribution within the combustion gases and that also directs heat removed from the combustion gases primarily at the cooking cavity floor. The convection oven of the present invention employs the conventional convection oven elements of a cooking cavity and a side-mounted blower fan for circulating air inside the cooking cavity. The oven also includes a combustion chamber located below the cooking cavity for heating combustion gases to be supplied to the cooking cavity. Combustion gases in the combustion chamber flow from the front of the oven to the back. Located between the combustion chamber and the cooking cavity is an intermediate flow chamber. The combustion gases from the combustion chamber traverse the intermediate flow chamber before traveling to the blower fan. Combustion gases in the intermediate flow chamber flow from the back of the oven to the front. By traveling the added distance of the intermediate flow chamber, the combustion gases are allowed to mix and achieve a more uniform heat distribution. In addition, some heat is removed from the combustion gases while traveling through the intermediate flow chamber; this heat is directed to the cooking cavity floor. In the preferred embodiment, a floor heat chamber is disposed between the intermediate flow chamber and the cooking cavity floor. A small amount of the combustion gases enter the floor heat chamber rather than flowing entirely through the intermediate flow chamber. While in the floor heat chamber, some of the heat from these combustion gases is transferred to the cooking cavity floor. The now cooler combustion gases from the floor heat chamber re-enter the intermediate flow chamber to be replaced by new, hotter combustion gases. By employing the intermediate flow chamber and a floor heat chamber, the convection oven of the present invention allows for combustion gases to be supplied to the cooking cavity with a more uniform heat distribution. The present invention also allows for heat removed from the combustion gases to be directed to the cooking cavity floor. In this manner, a more desirable cooking condition is achieved.

It is an object of the present invention to allow for heat removed from the combustion gases (prior to being circulated in the cooking cavity) to be supplied to the floor of the cooking cavity while still allowing for side-mounted blowers to be used.

It is another object of the present invention to provide a more uniform distribution of combustion gas temperatures to the blower fan.

DETAILED DESCRIPTION OF THE INVENTION

Figure 1:
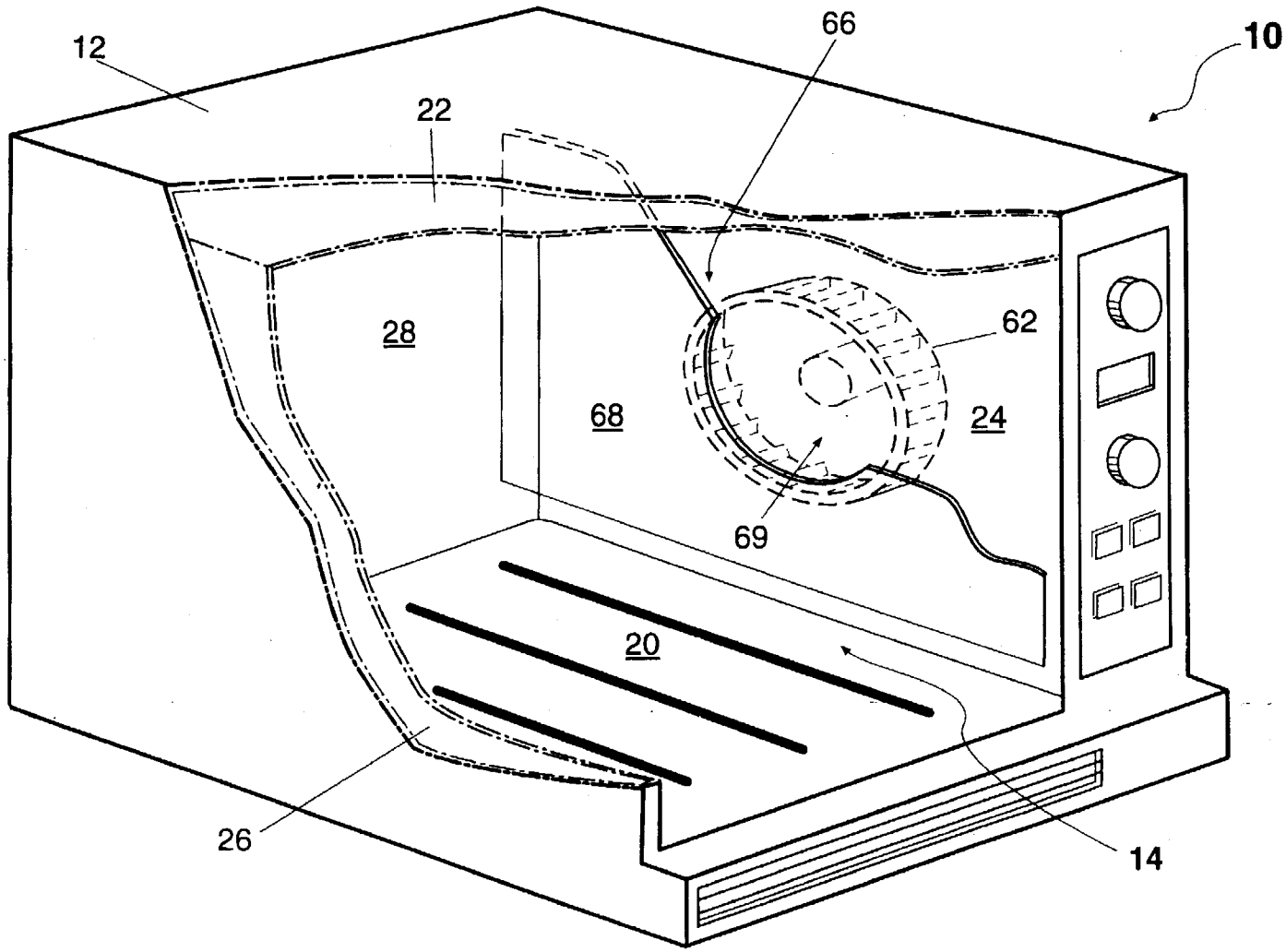
FIG. 1 is a perspective view of the convection oven of the present invention with doors removed for clarity.

The present invention is described more fully hereinafter by referring to the drawings, in which a preferred embodiment is depicted. However, the present invention can take on many different embodiments and is not intended to be limited to the embodiments described herein.

Referring now to the drawings in general, and FIG. 1 in particular, a convection oven, generally designated 10, is shown constructed according to the present invention. The convection oven 10 includes an insulated housing 12 that encompasses an internal cooking cavity 14 bounded by a front access door (not shown), a floor 20, a ceiling 22, two side walls 24 and 26, and a rear wall 28. The oven housing 12 may have any suitable form, shape, and size and includes conventional thermostats, timers, and other controlling devices.

Figure 2:
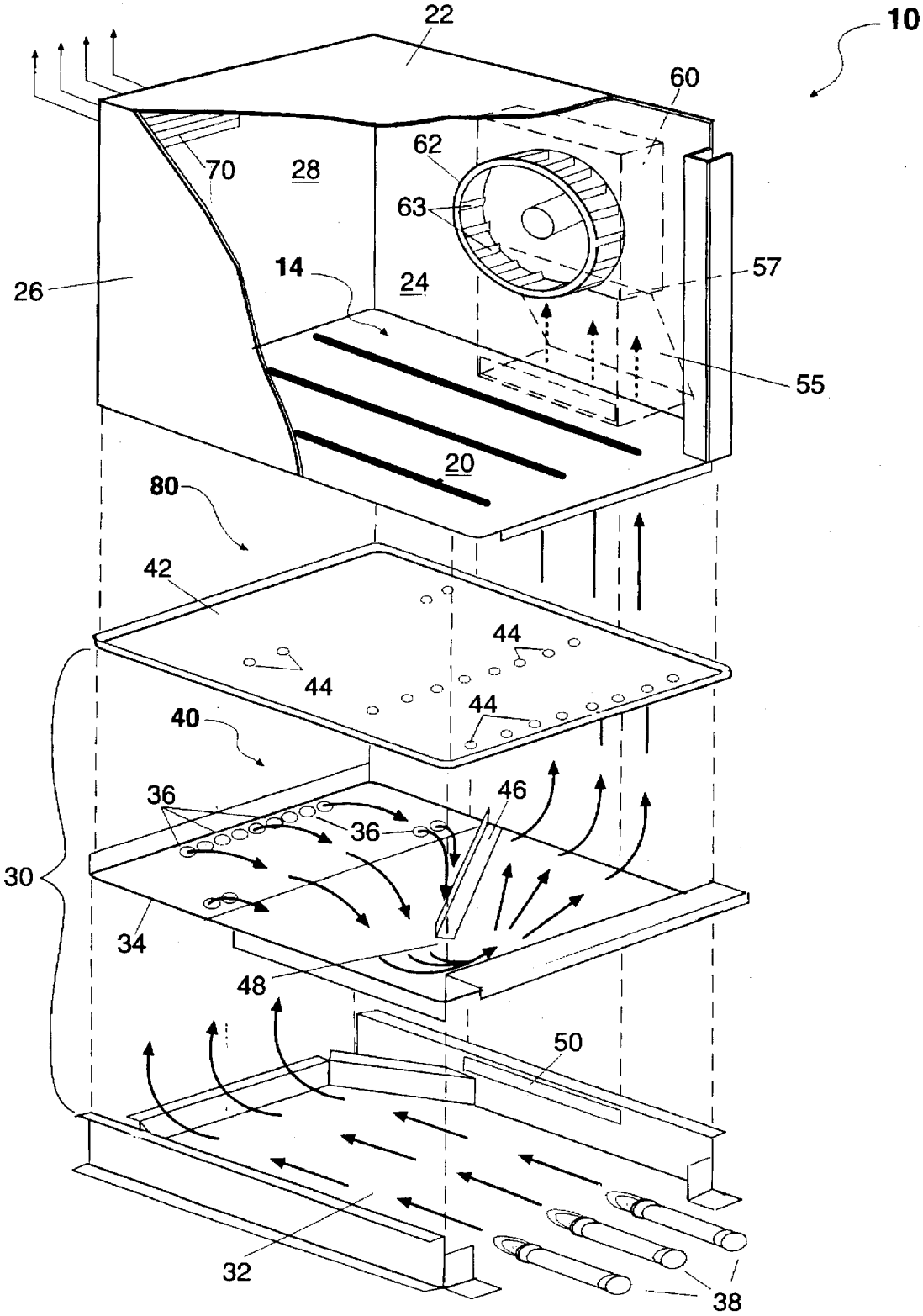
FIG. 2 is a perspective exploded view of the airflow portions of the present invention with the diffuser plate removed for clarity.

Referring now to FIG. 2, a heating chamber 30 is disposed within the housing 12, below the cooking cavity 14, to supply hot air to the cooking cavity 14. The heating chamber 30 includes a combustion chamber 32 and an intermediate flow chamber 40. The front end of the heating chamber 30 is open and communicates with ambient external air. The other end of the heating chamber 30 communicates with the blower fan 62 via the air duct 55. In the preferred embodiment, a separate floor heat chamber 80 is disposed between the heating chamber 30 and the cooking cavity 14.

Inside the heating chamber 30, air is heated in the combustion chamber 32. The combustion chamber 32 is located at the lowest part of the heating chamber 30. One or more heating elements 38 heat the air in the combustion chamber 32 before the air is introduced into the cooking cavity 14. Any conventional heating element may be used. For example, an electrical resistance heating element may be disposed in the combustion chamber 32 to heat air therein. However, in the preferred embodiment, three inshot type gas burners 38 are used, arranged laterally across the front of the convection oven 10. The preferred placement is such that the burners 38 are mostly in front of the combustion chamber 32, with only part of the burners 38 extending into the combustion chamber 32. The inshot burners 38 fire into and across the combustion chamber 32.

Figure 3:
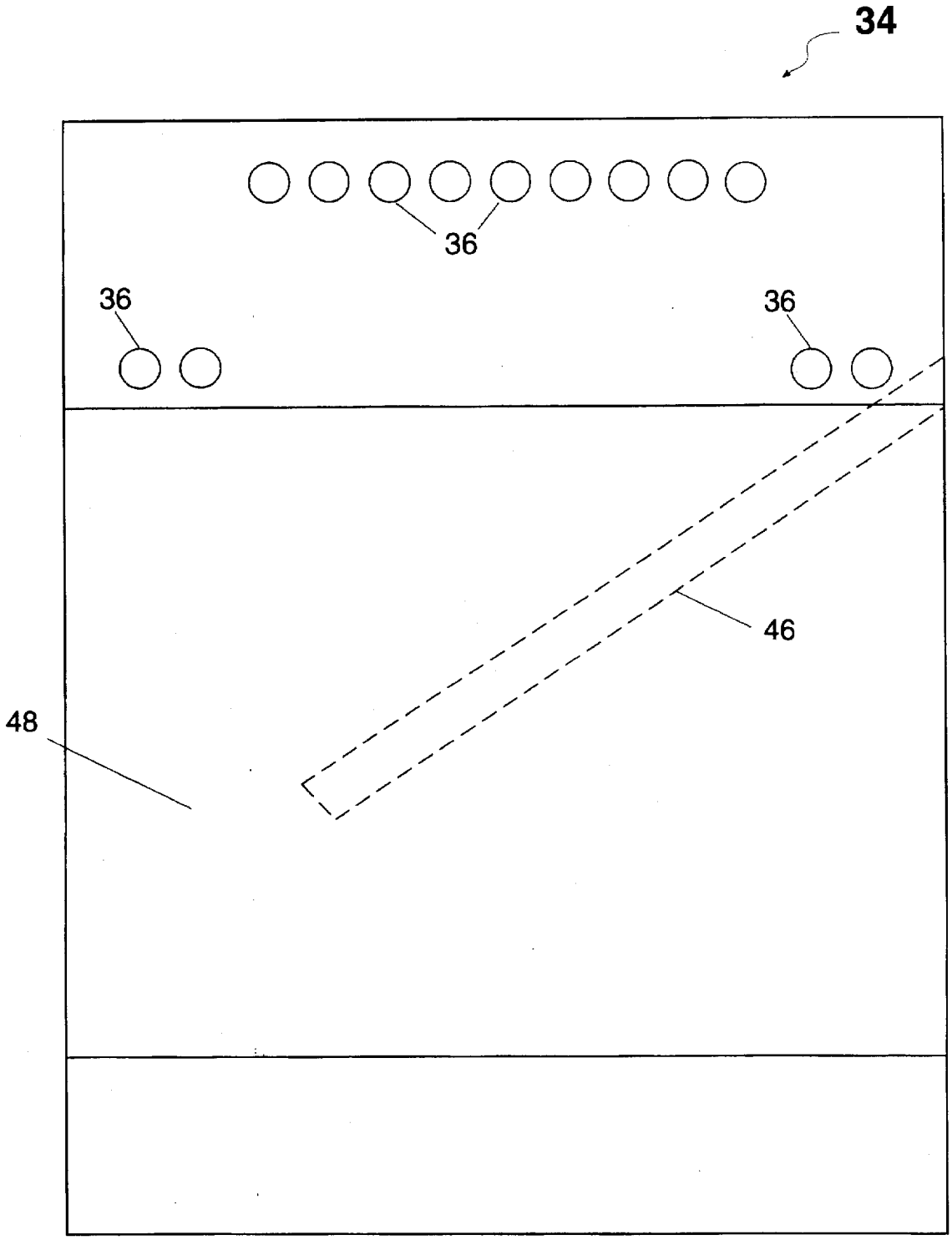
FIG. 3 is an overhead view of the separation plate.

Also inside the heating chamber 30, above the combustion chamber 32 and below the cooking cavity 14, is the intermediate flow chamber 40. A separation plate 34 defines the top of the combustion chamber 32 and the floor of the intermediate flow chamber 40. The rear portion of the separation plate 34 contains a number of flow holes 36, the number and placement of which will vary with the size and capacity of each oven (see FIG. 3). The purpose of the flow holes 36 is to allow for hot combustion gases to flow from the combustion chamber 32 into the intermediate flow chamber 40. Optionally within the intermediate flow chamber 40 is a deflector 46 (indicated by dashed lines in FIG. 3). The deflector 46 angles forwardly across the intermediate flow chamber 40 from the fan-side wall of the chamber towards the opposite side. The deflector 46 does not extend completely across, but instead stops short, leaving a flow gap 48. On the fan-side of the intermediate flow chamber 40, towards the front, is an opening 50 to the vertically extending air duct 55. The air duct 55 connects the intermediate flow chamber 40 with the blower box 60, terminating at an opening 57 in the lower portion of the blower box 60. The blower box 60 is a cavity behind the sidewall 24 of the cooking cavity 14 behind the blower fan 62. The blower box 60 communicates with the blower fan 62 through a sidewall opening (not shown) in the sidewall 24. The sidewall opening (not shown) is preferably round, slightly smaller in diameter than the blower fan 62, and located with its center along the central axis of the blower fan 62.

Figure 4:
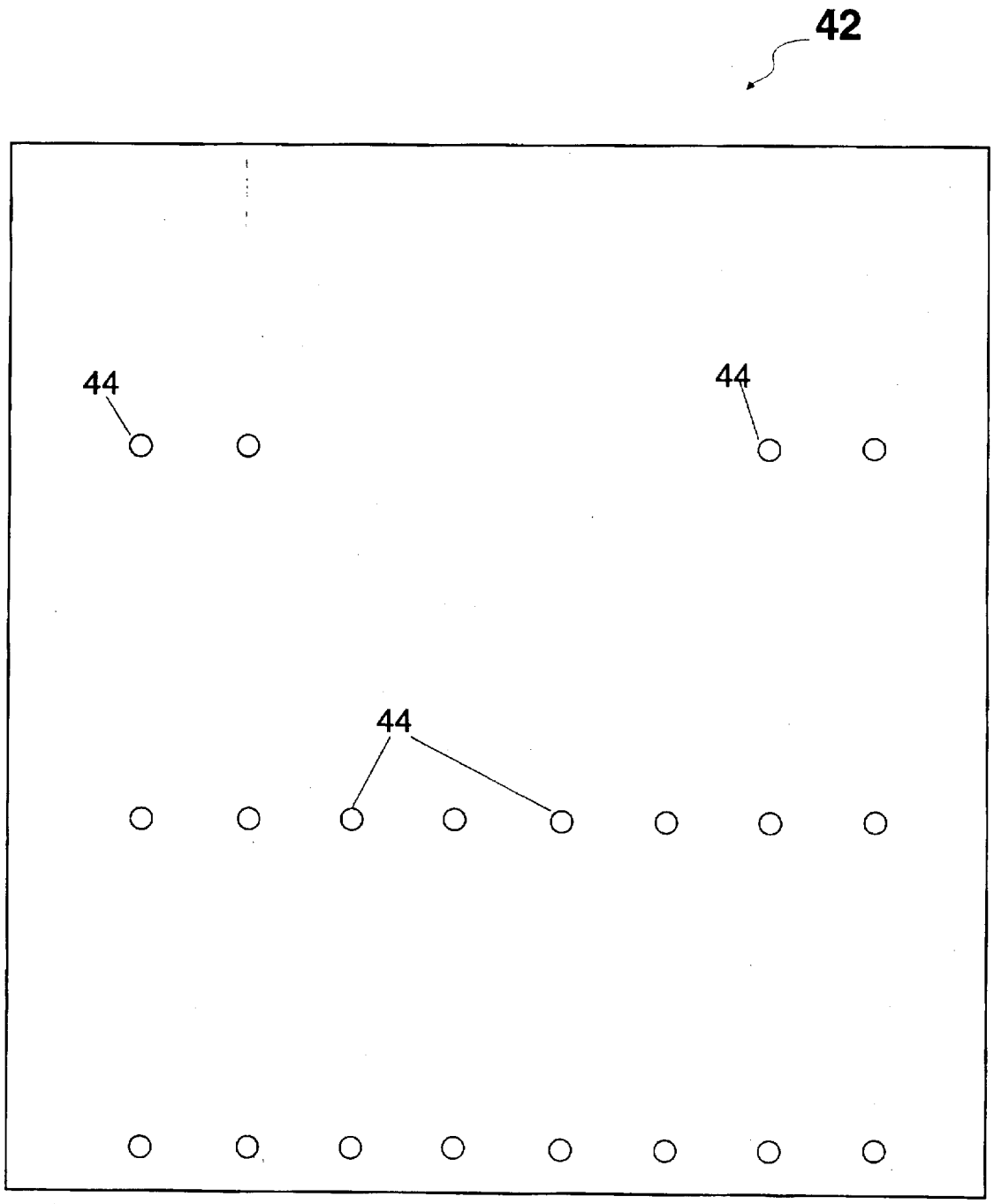
FIG. 4 is an overhead view of the baffle plate.

Directly above the intermediate flow chamber 40 is typically either insulation or the cooking chamber floor 20. However, in the preferred embodiment, a floor heat chamber 80 is located directly above the intermediate flow chamber 40 and directly below the cooking cavity floor 20. In this embodiment, the top of the intermediate flow chamber 40 is defined by a baffle plate 42. The baffle plate 42 also defines the lower surface of the floor heat chamber 80. The baffle plate 42 has a number of small convection holes 44 placed so as to allow some of the combustion gas to enter the floor heat chamber 80. The size(s), number, and location of the convection holes 44 will vary with oven size and capacity (see FIG. 4). The top of the floor heat chamber 80 is the cooking cavity floor 20.

As shown best in FIG. 1 and FIG. 2, a blower fan 62 is mounted against one of the walls 24 of the cooking cavity 14 for drawing heated air from the heating chamber 30 into the cooking cavity 14, circulating the heated air in the cooking cavity 14 to cook food therein, and expelling air through the exhaust 70. While the blower fan 62 may be mounted against the rear wall, it is preferably mounted against the sidewall 24 so as to allow for a smaller footprint of the overall oven 10. The blower fan 62 is rotated by a motor (not shown), which is preferably located so as to be isolated from heat emanating from the cooking cavity 14. The blower fan 62 is preferably wheel-shaped, having one row of blades 63 around its periphery. As the blower fan 62 rotates, air is drawn into its center from its front side then flung outwardly by the blades 63. The back of the blower fan 62 circumference is roughly parallel to the sidewall 24 and spaced about ¼ inch away.

In front of the blower fan 62, and between the blower fan 62 and the main cooking cavity 14, is a diffuser panel 68 that runs parallel to the sidewall 24, extending to within about one inch of the edge of the sidewall 24 in all four directions (top, bottom, front, and rear). The space between the diffuser panel 68 and the sidewall 24 defines the diffuser passage 66. The diffuser panel 68 has a recirculation input hole 69 (shown partially cutaway) centered on the axis of the blower fan 62, and smaller in diameter than the blower fan 62, so as to allow air already inside the cooking chamber to be pulled into the center of the blower fan 62. Air blown by the blower fan 62 travels through the diffuser passage 66 until being released into the main cooking chamber. The described blower apparatus embodiment is well known in the industry and particular design details are not important to understanding the present invention. The main function of the blower apparatus is to cause combustion gases to circulate after pulling them from the air duct 55, to re-circulate the recirculation air within the cooking cavity 14, and to cause the two air flows to mix before entering the main cooking cavity 14.

To exhaust air from the cooking cavity 14, an exhaust 70 is employed which communicatively connects the cooking cavity 14 with ambient air. Preferably, the entrance to the exhaust 70 is located on the upper portion of the rear wall 28 of the cooking cavity 14, towards the side opposite the blower fan 62.

In operation, air from outside the oven is drawn into the combustion chamber 32 of the preferred embodiment where it is heated via combustion. Combustion gases flow upwards through the flow holes 36 into the intermediate flow chamber 40. The combustion gases then flow towards the front of the oven 10, around by the deflector 46 at the flow gap 48, through the air duct opening 50, and on into the air duct 55. From the air duct 55, the combustion gases flow through the opening 57 to the blower box 60. As recirculation air is blown off the edges of the blower fan 62, a negative pressure develops, drawing the hot combustion gases from the blower box 60 via the sidewall opening (not shown) behind the blower fan 62. These combustion gases mix with the recirculating air while traveling the diffuser passage 66 so as to make the combined air flow more uniform in temperature. From the diffuser passage 66, the combined gases are blown out into the main cooking cavity 14. After flowing around the material to be baked, the gases are is sucked into the center of the fan via the recirculation input hole 69 and then blown back into the diffuser passage 66 by the blower fan 62. The gases recirculate in this manner until being forced out the exhaust 70 by the combination of convection and the input of new combustion gases into the cooking cavity 14. From the exhaust 70, the gases are transferred outside the oven.

While the new combustion gases are moving through the intermediate flow chamber 40, some portion of the gases pass through the convection holes 44 into the floor heat chamber 80, but the floor heat chamber 80 is not intended to have substantial gases flowing through it. The purpose of the floor heat chamber 80 is to allow some of the heat from the combustion gases to be transferred to the floor 20 of the cooking cavity 14. This is accomplished by allowing a small portion of the combustion gases to enter and exit the floor heat chamber 80 via the convection holes 44, thereby displacing some cooler gases already present there. The hot new gases will heat the floor 20 of the cooking cavity 14 and then be replaced by other, hotter, new gases. A separate chamber 80 is used rather than merely the floor 20 of the cooking cavity 14 so that unwanted hot spots will be less likely to develop and a more even distribution of heat can be achieved on the cooking cavity floor 20.

The combustion gases in the intermediate flow chamber 40 are intentionally forced to flow from the back of the oven 10 substantially all the way toward the front. This is done so that the heating of the cooking cavity floor 20 from underneath, through the floor heat chamber 80 in the preferred embodiment, will be more uniform. Similarly, the presence of the deflector 46 in the intermediate flow chamber 40 forces the main flow of the combustion gases into regions of the intermediate flow chamber 40 that might otherwise experience reduced flow.

Using an intermediate flow chamber 40 below the cooking cavity 14, either directly or with an intervening floor heat chamber 80, results in two beneficial effects. First, because of the distance covered, the combustion gases are given the opportunity to mix within themselves to achieve a more uniform temperature distribution. Second, some of the heat from the new combustion gases is transferred to the cooking cavity floor 20, resulting in a more desirable cooking condition within the cooking cavity 14. Including a floor heat chamber 80 between the intermediate flow chamber 40 and the cooking cavity floor 20 further enhances the cooking condition within the cooking cavity 14 by helping to reduce temperature variations in the floor 20, once again resulting in a more desirable cooking condition.

The present invention has application with a wide variety of oven sizes and capacities. One such oven has a capacity of 11 pans (3.8 cubic feet) and has external dimensions of approximately 30 inches by 26½ inches by 29 inches. Such an oven would use three inshot burners 38 of 30,000 Btu rating, a 300 cfm blower fan 62, and a deflector 46 that extends about two-thirds of the way across the intermediate flow chamber 40. In addition, the separation plate 34 has thirteen flow holes 36 of ¾ inch diameter arranged in the pattern shown in FIG. 3. Also, the baffle plate 42 has twenty convection holes 44 of 5/16 inch diameter arranged in the pattern shown in FIG. 4.

What I claim is:

1. A convection oven, comprising:

a) a cooking cavity having sidewalls, a ceiling and a floor;

b) a combustion chamber below said cooking cavity for heating said cooking cavity; said combustion chamber having a front portion, a middle portion, and a rear portion;

c) a blower fan for circulating air inside said cooking cavity;

d) a generally horizontal intermediate flow chamber having a rear portion, a middle portion, and a front portion; said intermediate flow chamber disposed between said cooking cavity and said combustion chamber; said intermediate flow chamber being in communication with both said combustion chamber and said blower fan so that said blower fan pulls heated air from said combustion chamber through said intermediate flow chamber and out into said cooking cavity; and e) wherein the majority of said heated air flows substantially horizontally through said combustion chamber to the rear portion thereof, upwards into said intermediate flow chamber, substantially horizontally to the front portion of said intermediate flow chamber, and to said cooking cavity.

2. The convection oven of claim 1 wherein said intermediate flow chamber includes an air deflector for more evenly distributing heat.

3. The convection oven of claim 1 further comprising a floor heat chamber disposed between said floor of said cooking cavity and said intermediate flow chamber for more evenly distributing heat to said floor of said cooking cavity.

4. The convection oven of claim 1 wherein the flow of said heated air through said rear portion and said middle portion of intermediate flow chamber is substantially in a plane parallel to and in an opposite direction from the flow of said heated air through said combustion chamber.

5. The convection oven of claim 1 further comprising a heating means.

6. The convection oven of claim 5 wherein said heating means includes a plurality of inshot burners.

7. A convection oven, comprising:

a) a cooking cavity having sidewalls, a ceiling and a floor;

b) a combustion chamber below said cooking cavity for heating said cooking cavity;

c) a blower fan for circulating air inside said cooking cavity;

d) a generally horizontal intermediate flow chamber disposed between said cooking cavity and said combustion chamber; said intermediate flow chamber being in communication with both said combustion chamber and said blower fan so that said blower fan pulls heated air from said combustion chamber through said intermediate flow chamber and out into said cooking cavity; and e) a floor heat chamber disposed between said floor of said cooking cavity and said intermediate flow chamber for more evenly distributing heat to said floor of said cooking cavity; wherein said floor heat chamber is partially open to said intermediate flow chamber on its lower side.

8. A convection oven, comprising:

a) a cooking cavity having sidewalls, a ceiling and a floor;

b) a blower fan for circulating air inside said cooking cavity;

c) a generally horizontal combustion chamber disposed below said cooking cavity for heating said cooking cavity; said combustion chamber having at least one inlet for air in the front thereof;

d) a heating means projecting into said combustion chamber;

e) a generally horizontal intermediate flow chamber disposed between said cooking cavity and said combustion chamber having a rear portion, a middle portion, and a front portion;

f) a passage connecting the rear portion of said combustion chamber to the rear portion of said intermediate flow chamber so that heated air from said combustion chamber can flow into the rear portion of said intermediate flow chamber; and g) a vertically extending air duct; said air duct in communication with said intermediate flow chamber and said blower fan so that said blower fan pulls heated air from said inlet, through said combustion chamber in a rearward direction, through said passage, through said intermediate flow chamber to the front portion of said intermediate flow chamber in a substantially forward direction, through said air duct, and out into said cooking cavity.

9. The convection oven of claim 8 wherein said intermediate flow chamber includes an air deflector for more evenly distributing heat.

10. The convection oven of claim 8 further comprising a floor heat chamber disposed between said floor of said cooking cavity and said intermediate flow chamber for more evenly distributing heat to said floor of said cooking cavity.

11. The convection oven of claim 8 wherein said heating means includes a plurality of inshot burners.

12. A convection oven, comprising:

a) a cooking cavity having sidewalls, a ceiling and a floor;

b) a blower fan for circulating air inside said cooking cavity;

c) a generally horizontal combustion chamber disposed below said cooking cavity for heating said cooking cavity; said combustion chamber having at least one inlet for air in the front thereof;

d) a heating means within said combustion chamber;

e) a generally horizontal intermediate flow chamber disposed between said cooking cavity and said combustion chamber;

f) a passage connecting the rear portion of said combustion chamber to the rear portion of said intermediate flow chamber so that heated air from said combustion chamber can flow into the rear portion of said intermediate flow chamber;

g) a vertically extending air duct; said air duct in communication with said intermediate flow chamber and said blower fan so that said blower fan pulls heated air from said inlet, through said combustion chamber in a rearward direction, through said passage, through said intermediate flow chamber in at least a partially forward direction, through said air duct, and out into said cooking cavity; and h) a floor heat chamber disposed between said cooking cavity and said intermediate flow chamber for more evenly distributing heat to said floor of said cooking cavity; wherein said floor heat chamber is partially open to said intermediate flow chamber on its lower side.

13. The convection oven of claim 7 wherein said heating means includes a plurality of inshot burners.

14. A convection oven, comprising:

a) a cooking cavity having sidewalls, a ceiling and a floor;

b) a blower fan for circulating air inside said cooking cavity;

c) a heating chamber below said cooking cavity for heating said cooking cavity;

d) a first horizontal chamber within said heating chamber;

e) a second horizontal chamber within said heating chamber and above said first horizontal chamber, wherein said second horizontal chamber is in communication with said first horizontal chamber and said blower fan; and f) a predominant air flow path through said first horizontal chamber, up and into said second horizontal chamber, through said second horizontal chamber, and to said blower fan, wherein said air flow path in said first and second horizontal chambers is in substantially opposite directions.

* * * * *